US006439125B1

(12) United States Patent
Carter

(10) Patent No.: US 6,439,125 B1
(45) **Date of Patent: *Aug. 27, 2002**

(54) BULLET

(75) Inventor: Herman L. Carter, Houston, TX (US)

(73) Assignee: Friedkin Companies, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/013,962

(22) Filed: Jan. 27, 1998

(51) Int. Cl.[7] ..... F42B 12/34; F42B 14/02
(52) U.S. Cl. ..... 102/507; 102/514; 102/524
(58) Field of Search ..... 102/430, 439, 102/501, 511, 514–518, 524, 526, 507–510

(56) References Cited

U.S. PATENT DOCUMENTS

| | | | | | |
|---|---|---|---|---|---|
| 2,120,913 | A | * | 6/1938 | Studler | 102/516 |
| 2,234,165 | A | * | 3/1941 | Hatcher et al. | 102/526 |
| 2,333,091 | A | | 11/1943 | Crasnoff | 102/91 |
| 2,568,078 | A | * | 9/1951 | McGahey, Jr. | 102/430 |
| 2,792,618 | A | | 5/1957 | Walker | 29/1.23 |
| 2,838,000 | A | | 6/1958 | Schreiber | 102/92.5 |
| 3,003,420 | A | | 10/1961 | Nosler | 102/91 |
| 3,069,748 | A | | 12/1962 | Nosler | 29/1.23 |
| 3,143,966 | A | | 8/1964 | Burns, Jr. et al. | 102/91 |
| 3,918,364 | A | * | 11/1975 | Duer | 102/501 |
| 4,336,756 | A | | 6/1982 | Schreiber | 102/516 |
| 4,879,953 | A | * | 11/1989 | Carter | 102/507 |
| 5,463,960 | A | * | 11/1995 | Lowry | 102/524 |
| 5,686,693 | A | * | 11/1997 | Jakobsson | 102/524 |

FOREIGN PATENT DOCUMENTS

| | | | | |
|---|---|---|---|---|
| DE | 40875 | * | 10/1887 | 102/501 |
| DE | 48041 | | 1/1989 | |
| FR | 776005 | | 1/1935 | |
| GB | 1972 | * | 4/1883 | 102/430 |

* cited by examiner

*Primary Examiner*—Harold J. Tudor
(74) *Attorney, Agent, or Firm*—Locke Liddell & Sapp LLP

(57) ABSTRACT

The invention relates to a bullet having a tapered nose and a cylindrical base. The base is provided with an annular groove having a diameter less than the bore diameter of the barrel of the gun from which it is fired to reduce the force required to move the bullet through the barrel to increase the muzzle velocity and kinetic energy of the bullet.

11 Claims, 3 Drawing Sheets

BULLET

This invention relates to bullets generally, and in particular to small arms bullets in calibers from 0.224 inch to 0.500 inch of the bonded core, solid shank, soft nose, controlled expansion type used for hunting, self-defense, military, and law enforcement purposes.

This invention is an improvement on the bullets described in U.S. Pat. No. 5,621,186 dated Apr. 15, 1997, U.S. Pat. No. 5,641,937 dated Jun. 24, 1997, and U.S. Pat. No. 4,879,953 dated Nov. 14, 1989.

Present day bullets are assembled with a cartridge filled with a powder charge. When fired, the bullet travels through a gun barrel having spiral grooves with spiral lands between the grooves. The diameter of the bullet is equal to or slightly less than the diameter of the grooves but greater than the diameter of the lands so that spiral grooves are formed in the cylindrical section of the bullet that follow the spiral and cause the bullet to be rotating on its longitudinal axis when it leaves the barrel. This improves the accuracy of the gun.

Thus, the pressure exerted on the bullet by the burning powder of the cartridge accelerates the bullet as it travels through the barrel and also provides the force required for the lands to cut spiral grooves in the bullet causing it to be spinning on its longitudinal axis as it leaves the barrel.

It is an object and feature of this invention to reduce the force required to cut the spiral grooves and thereby increase the muzzle velocity of the bullet, which also increases the kinetic energy of the bullet without reducing the rate at which the bullet spins.

It is a further object of this invention to provide a controlled expansion bullet that will obtain higher muzzle velocities with the same pounds per square inch pressures provided by the cartridge that are established by the American National Standards Institute and published by Sporting Arms and Ammunition Manufacturers, Inc. These standards are generally known in the ammunition industry as "ANSI/SAMMI."

It is also an object of this invention to substantially reduce the length of the portion of the outer surface of the bullet that is in engagement with the lands and grooves of the barrel as the bullet travels through the barrel and thus increases the amount of the energy produced by the burning powder that is available to accelerate the bullet as it travels through the barrel.

The twist of the grooves in the barrel of a firearm produces the spin of the bullet and the twist ranges from one turn in 9.5 inches to as slow as one turn in 20 inches. The number of rifling lands in a conventional barrel normally ranges from as low as four to as high as six. The height of the rifling lands ranges from 0.0025 inch to 0.007 inch.

It is a further object and feature of this invention to provide a bullet having a circumferential groove in the base shank section of the bullet having a diameter less than the diameter of the lands between the grooves to decrease the force required to force the bullet through the barrel and thereby increase the muzzle velocity of the bullet.

Another object of this invention is to provide a uniform and equal friction reduction on all weights of bullets of the same diameter.

These and other objects, advantages, and features of this invention will be obvious to those skilled in the art from a consideration of this specification including the attached drawing and appended claims.

IN THE DRAWINGS

FIGS. 7*a–d* show how the weight of a bullet of the same caliber is increased by adding metal to the rear of the bullet.

Figure 1:
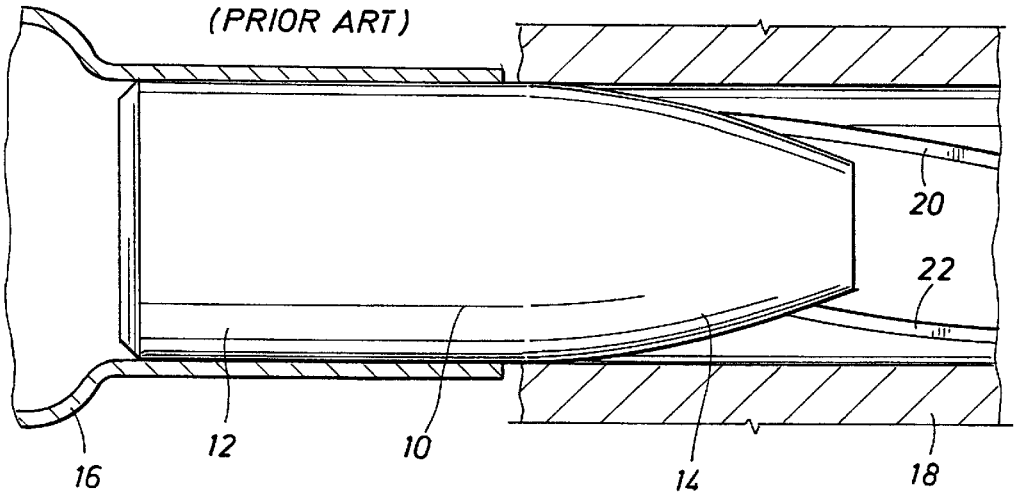
FIG. 1 (PRIOR ART)
FIG. 1 is a view partly in section and partly in elevation of a bottleneck cartridge assembled with a typical prior art bullet.

As shown in FIG. 1, when cartridge 16 is positioned in the chamber of a gun, the nose 14 of the bullet of the cartridge usually extends into the barrel 18 and is at least partly in engagement with the spiral lands 20 between spiral grooves 22 in the barrel since cylindrical portion 10 of the bullet has a diameter equal to or slightly less than the diameter of the grooves. This insures that the grooves will impart the desired rotation to the bullet as it travels through the barrel. At the same time, the lands cut grooves in the portion of the bullet having a diameter larger than that of the lands.

Set out below in Schedule A are the dimensions of thirteen bullets of varying calibers modified in accordance with this invention. In each case, the difference between the groove diameter and the bore diameter is an approximation of the metal that is displaced as the lands cut grooves in the cylindrical portion of the bullet. The FRB or Force Reducing Band has a diameter less than the bore diameter so no metal is displaced over that portion of the cylindrical portion of the bullet, which reduces substantially the force required to move the bullet through the barrel of the gun.

Figure 4:
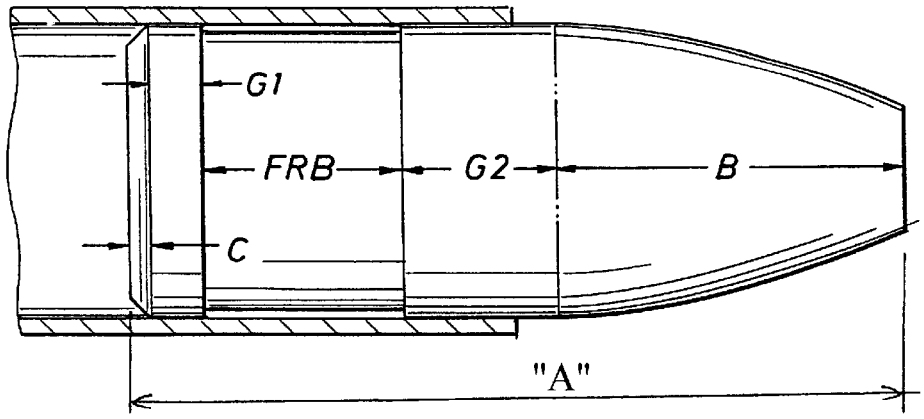
FIG. 4 is a view partly in section and partly in elevation of a cylindrical cartridge assembled with the bullet of this invention.

Schedule A includes data for primarily rifle bullets as shown by the calibers presented and is intended to be interpreted in conjunction with FIG. 4. The overall length of the bullet "A" is listed and is an accumulation of the bullet ogive length "B" on a tapered end (to the right in FIG. 4), the bullet chamfer length "C" on the distal end from the tapered end (to the left in FIG. 4), and the associated lengths therebetween. For purposes of Schedule A, the bullet length at a groove diameter of a barrel is labeled "G" and is a combination of G1 and G2 shown in FIG. 4. The bullet length at the FRB reduced diameter is labeled "F".

For comparison, a standard bullet length "D" of the groove diameter of the barrel that contacts the lands in the barrel (i.e., the base shank) is shown and can be contrasted with the length "G" (G1+G2) of the bullet of the present invention that can contact the lands in the barrel. The reduction in the bullet length at the groove diameter can be calculated by reviewing the table values and are shown in column "H". The formula is $H=1-(^{G}/_{D})$. For example, for a 223 Rem. bullet, the values are D=0.313 and G=0.183. The reduction in length of the bullet at the groove diameter is 1−(0.183/0.313)=0.42 or 42%. The other values in Schedule A can be calculated accordingly.

Schedule D, primarily pistol bullets as shown by the calibers presented, is similarly intended to be interpreted in conjunction with FIG. 4. Together with Schedule A, the exemplary values for "H" range from a calculation of about 41% to about 65% reduction in groove length. For rifle bullets in Schedule A, the range is between about 41% and 61%. For pistol bullets in Schedule D, the range is between about 50% and 65%.

A similar calculation can be derived from Schedules A and D by calculating the combined length "G" compared to the overall length of the bullet "A" and is shown in column "I". For example, for the 223 bullet above, the combined length "G" (G1+G2) divided by the overall length "A" is 0.183/0.730 or about 25%. Similar calculations can be made for the other bullets shown in both Schedules. Together Schedules A and D show that the exemplary values range from a calculation of about 14% to about 31%. For rifle bullets in Schedule A, the range is between about 14% and 31%. For pistol bullets in Schedule D, the range is between about 17% and 25%.

As a consequence, the muzzle velocity of the bullet is increased substantially, which, in turn, increases the kinetic energy imparted to the bullet.

A comparison of the muzzle velocity and kinetic energy between "standard" bullets, i.e., bullets without a FRB and bullets with a FRB is indicated below in Schedule B.

Schedule B provides data for primarily rifle bullets for the calibers shown in Schedule A. The velocities and energies are shown at a maximum average pressure as recommended by S.A.M.M.I. As shown, the bullets of the present invention have a greater velocity and energy compared to the standard bullets and yield about 7% increased velocity and about 14% increased energy at a comparable pressure with the standard bullets. The exemplary range of velocities is between about 2236 feet per second (fps) to about 3466 fps. The exemplary range of kinetic energies is between about 1459 to about 5872 foot pounds.

Schedule E provides similar data for primarily pistol bullets for the calibers shown in Schedule D with corresponding increases in velocity and energy. The exemplary range of velocities is between about 909 fps to about 1327 fps exclusive of the 458 Win. Mag. The exemplary range of kinetic energies for the same calibers is between about 291 foot pounds to about 844 foot pounds. Schedule E together with Schedule B provide a combined range of velocities for the bullets of about 909–3466 fps and of kinetic energies of about 291–5872 foot pounds.

SCHEDULE A

METHOD OF REDUCTION IN LENGTH OF BULLET AT GROOVE DIAMETER WITH FRICTION REDUCTION BAND (FRB)
THE BOTTLENECK TYPE CARTRIDGE CASES AND BARREL DIMENSIONS ARE BASED ON ANSI/SAMMI SPECIFICATIONS.

| CARTRIDGE TYPE, BULLET WGT., GROOVE DIA., BORE DIA., AND FRACTION REDUCTION BAND DIA. | A Bullet Overall Lgth | B Bullet Ogive Lgth | C Bullet Chamber Lgth | D Standard Bullet Lgth Groove Dia. | E Cartridge Neck Lgth | F Bullet Lgth. at FRB Dia. | G Bullet Lgth Groove Dia. | H Reduction % D. Col. Lgth | I "G"/"A" |
|---|---|---|---|---|---|---|---|---|---|
| 223 Rem. Bullet wgt. 55 grs. Groove dia. .224 bore dia .219 FRB dia. .217 | .730 | .382 | .035 | .313 | .247 | .130 | .183 | 42% | 25% |
| 243 Win. Bullet wgt. 100 grs. Groove dia. .243 bore dia. .237 FRB dia. .2335 | 1.060 | .685 | .035 | .340 | .260 | .180 | .150 | 53% | 14% |
| 25/06 Rem. Bullet wgt. 115 grs. Groove dia. .257 bore dia. .250 FRB dia. .248 | 1.142 | .600 | 0.35 | .507 | .309 | .250 | .257 | 49% | 23% |
| 264 Win. Mag. Bullet wgt. 140 grs. Groove dia. .265 bore dia. .256 FRB dia. .254 | 1.262 | .615 | .035 | .612 | .332 | .275 | .337 | 45% | 27% |
| 270 Win. Bullet wgt. 140 grs. Groove dia. .277 bore dia. .270 FRB dia. .268 | 1.158 | .622 | .035 | .571 | .395 | .300 | .296 | 52% | 26% |
| 7 mm Rem. Mag. Bullet wgt. 160 grs. Groove dia. .284 bore dia. .276 FRB dia. .274 | 1.135 | .590 | .035 | .510 | .272 | .250 | .249 | 49% | 22% |
| 30/06 Sprg. Bullet wgt. 165 grs. Groove dia. .308 bore dia. .300 FRB dia. .298 | 1.147 | .626 | .035 | .486 | .386 | .224 | .261 | 54% | 23% |
| 8 mm Rem. Mag. Bullet wgt. 225 grs. Groove dia. .323 bore dia. .317 FRB dia. .315 | 1.330 | .650 | .040 | .640 | .320 | .280 | .360 | 44% | 27% |
| 338 Win. Mag. Bullet wgt. 225 grs. Groove dia. .338 bore dia. .330 FRB dia. .328 | 1.324 | .679 | .040 | .605 | .331 | .280 | .325 | 46% | 25% |
| 35 Whelen Bullet wgt. 225 grs. Groove dia. .357 bore dia. .349 FRB dia. .345 | 1.175 | .543 | .040 | .592 | .462 | .325 | .267 | 54% | 23% |
| 375 H & H Mag. Bullet wgt. 300 grs. Groove dia. .375 bore dia. .366 FRB dia. .362 | 1.385 | .615 | .040 | .730 | .352 | .300 | .430 | 41% | 31% |
| 416 Rem. Mag. Bullet wgt. 400 grs. | 1.489 | .623 | .045 | .821 | .429 | .375 | .446 | 46% | 30% |

SCHEDULE A-continued

METHOD OF REDUCTION IN LENGTH OF BULLET AT GROOVE DIAMETER WITH FRICTION REDUCTION BAND (FRB)
THE BOTTLENECK TYPE CARTRIDGE CASES AND BARREL DIMENSIONS ARE BASED ON ANSI/SAMMI SPECIFICATIONS.

| CARTRIDGE TYPE, BULLET WGT., GROOVE DIA., BORE DIA., AND FRACTION REDUCTION BAND DIA. | A Bullet Overall Lgth | B Bullet Ogive Lgth | C Bullet Chamber Lgth | D Standard Bullet Lgth Groove Dia. | E Cartridge Neck Lgth | F Bullet Lgth. at FRB Dia. | G Bullet Lgth Groove Dia. | H Reduction % D. Col. Lgth | I "G"/"A" |
|---|---|---|---|---|---|---|---|---|---|
| Groove dia. .416 bore dia. .408 FRB dia. .404 470 Nitro Bullet wgt. 500 grs. Groove dia. .474 bore dia. .458 FRB dia. .454 | 1.320 | .628 | .045 | .647 | .765 | .400 | .247 | 61% | 19% |
| | | | | | AVERAGE FRICTION REDUCTION | | | 49% | |

SCHEDULE B

INCREASE IN VELOCITY AND MUZZLE ENERGY OF BULLETS IN BOTTLENECK CARTRIDGES THE CARTRIDGES, STANDARD VELOCITY, STANDARD ENERGY, AND MAXIMUM AVERAGE PRESSURES ARE BASED ON ANSI/SAMMI SPECIFICATIONS.

| | B Standard Velocity Ft. Per Sec | C Standard Energy Foot Pound | D S.A.M.M.I. Max. Avg. Pressure | E 7% Increased Velocity | F 14% In-creased Energy |
|---|---|---|---|---|---|
| 223 Rem. | 3240 | 1280 | 52,000 | 3466 | 1459 |
| 243 Win. | 2960 | 1950 | 60,000 | 3167 | 2226 |
| 25/06 Rem. | 2990 | 2285 | 63,000 | 3199 | 2613 |
| 264 Win. | 3030 | 2854 | 68,100 | 3267 | 3267 |
| 270 Win. | 2940 | 2685 | 69,100 | 3145 | 3074 |
| 7 mm Rem. Mag. | 2940 | 3070 | 64,800 | 3145 | 3513 |
| 30-06 Sprg. | 2800 | 2872 | 60,000 | 2996 | 3288 |
| 338 Win. | 2800 | 3915 | 68,100 | 2996 | 4484 |
| 35 Whelen | 2500 | 3120 | 52,000 cup | 2674 | 3574 |
| 375 H & H | 2530 | 4265 | 66,000 | 2707 | 4880 |
| 416 Rem. | 2400 | 5115 | 69,100 | 2568 | 5856 |
| 458 Win. | 2090 | 4850 | 53,000 cup | 2236 | 5550 |
| 470 Nitro | 2150 | 5130 | 35,000 cup | 2300 | 5872 |

SCHEDULE B-continued

INCREASE IN VELOCITY AND MUZZLE ENERGY OF BULLETS IN BOTTLENECK CARTRIDGES THE CARTRIDGES, STANDARD VELOCITY, STANDARD ENERGY, AND MAXIMUM AVERAGE PRESSURES ARE BASED ON ANSI/SAMMI SPECIFICATIONS.

| | B Standard Velocity Ft. Per Sec | C Standard Energy Foot Pound | D S.A.M.M.I. Max. Avg. Pressure | E 7% Increased Velocity | F 14% In-creased Energy |
|---|---|---|---|---|---|

S.A.M.M.I recognizes two methods of measuring centerfire rifle pressures - The older Copper Crusher System and the modern Piezoelectric Transducer System.

Schedule C below is a chart of 13 different gun barrels for 13 different caliber bullets comparing the width of the lands in each barrel to the circumference of the bullet of the same caliber.

SCHEDULE C

THE BOTTLENECK CARTRIDGES AND INTERNAL BARREL CHARACTERISTICS ARE BASED ON ANSI/SAMMI SPECIFICATIONS.

| | A Twist one turn in inches | B Number of Grooves | C Bullet circum-ference | D Width of Grooves | E Width of Groove | F Depth of Groove | G Width of Lands | H Width of Land | I % of col. G to col. C |
|---|---|---|---|---|---|---|---|---|---|
| 223 Rem. | 14 | 6 | .703 | .480 | .080 | .0025 | .223 | .037 | .317 |
| 243 Win. | 10 | 6 | .763 | .408 | .068 | .003 | .354 | .059 | .464 |
| 25/06 Rem. | 10 | 6 | .807 | .576 | .096 | .0035 | .231 | .0385 | .286 |
| 264 Win. | 9 | 6 | 829 | .540 | .090 | .004 | .289 | .048 | .349 |
| 270 Win. | 10 | 4 | .870 | 640 | .160 | .0035 | .230 | .0575 | .264 |
| 7 mm Rem. | 9.5 | 6 | 892 | .660 | .110 | .0035 | .232 | .038 | .260 |
| 30-06 Sprg. | 10 | 4 | 968 | .706 | .1767 | .004 | .262 | .065 | .270 |
| 8 mm Mag. | 10 | 6 | 1.045 | .732 | .122 | .004 | .313 | .052 | .427 |
| 338 Win. | 10 | 6 | 1.062 | .660 | .110 | .004 | .402 | .067 | .473 |
| 35 Whelen | 16 | 6 | 1.124 | .780 | .130 | .004 | .344 | .057 | .306 |
| 375 H & H | 12 | 6 | 1.178 | .690 | .115 | .006 | .488 | .081 | .414 |
| 416 Rem. | 14 | 6 | 1.307 | .768 | .168 | .004 | .539 | .089 | .413 |
| 458 Win. | 14 | 6 | 1.439 | .900 | .150 | .004 | .539 | .090 | .374 |
| 470 Nitro | 14 | 6 | 1.489 | .960 | .160 | .007 | .529 | .088 | .355 |

Schedule D below indicates the reduction in the length of a standard bullet in engagement with the lands and grooves compared to the bullet of this invention. The average reduction is about 58%

SCHEDULE D

METHOD OF REDUCTION IN LENGTH OF BULLET AT GROOVE DIAMETER WITH FRICTION REDUCTION BAND (FRB) THE CYLINDRICAL OR TAPERED WALL CARTRIDGE CASI CASES AND BARRELL DIMENSIONS ARE BASED ON ANSI/SAMMI SPECIFICATIONS.

| CARTRIDGE TYPE, BULLET WGT., GROOVE DIA., BORE DIA., AND FRACTION REDUCTION BAND DIA. | A Bullet OAL | B Bullet Ogive Lgth | C Bullet Chamber | D Standard Bullet Lgth Groove Dia. | E Cartridge Neck | F Bullet at Dia. FRB | G Bullet at Groove Dia. | H Reduction % D Co. | I "G"/"A" |
|---|---|---|---|---|---|---|---|---|---|
| 9 mm Luger Bullet wgt. 124 grs. Groove dia. .355 bore dia .346 FRB dia. 342 | .570 | .250 | .035 | .285 | 0 | .185 | .100 | 65% | 18% |
| 38 Special Bullet wgt. 129 grs. Groove dia. .355 bore dia. .346 FRB dia. .342 | .600 | .320 | .035 | .245 | 0 | .145 | .100 | 59% | 17% |
| 357 Magnum Bullet wgt. 158 grs. Groove dia. .355 bore dia. .346 FRB dia. .342 | .675 | .300 | .035 | .340 | 0 | .200 | .140 | 59% | 21% |
| 10 mm Auto Bullet wgt. 180 grs. Groove dia. .400 bore dia. .390 FRB dia. .386 | .600 | .300 | .035 | .265 | 0 | .165 | .100 | 62% | 17% |
| 40 S & W Bullet wgt. 165 grs. Groove dia. .400 bore dia. .390 FRB dia. .386 | .585 | .340 | .035 | .210 | 0 | .110 | .100 | 52% | 17% |
| 44 Rem Mag Bullet wgt. 240 grs. Groove dia. .429 bore dia. .417 FRB dia. .413 | .750 | .350 | .035 | .365 | 0 | .200 | .165 | 55% | 22% |
| 45 Auto Bullet wgt. 230 grs. Groove dia. .450 bore dia. .442 FRB dia. .438 | .675 | .283 | .035 | .357 | 0 | .180 | .170 | 50% | 25% |
| 45 Colt Bullet wgt. 225 grs. Groove dia. .450 bore dia. .442 FRB dia. .438 | .600 | .283 | .035 | .282 | 0 | .175 | .107 | 62% | 18% |
| .458 Win Mag Bullet wgt. 500 grs. Groove dia. .458 bore dia. .450 FRB dia. .446 | 1.379 | .650 | .045 | .684 | 0 | .400 | .284 | 58% | 21% |
| | | | | | AVERAGE FRICTION REDUCTION | | | 58% | |

Schedule E indicates the increase in muzzle velocity and kinetic energy of bullets of this invention compared with standard bullets of the same caliber.

SCHEDULE E

INCREASE IN VELOCITY AND MUZZLE ENERGY OF BULLETS IN CYLINDRICAL OR TAPERED WALL CARTRIDGE CASES. THE CARTRIDGES, STANDARD VELOCITY, STANDARD ENERGY, AND MAXIMUM AVERAGE PRESSURES ARE BASED ON ANSI/SAMMI SPECIFICATIONS.

| | A Bullet Wgt. | B Standard Velocity Ft. Per Sec. | C Standard Energy Ft. Pounds | D SAMMI Max. Avg. P.S.I. | E 7% Increased Velocity | F 14% Increased Energy |
|---|---|---|---|---|---|---|
| 9 mm Luger Bullet | 124 | 1120 | 345 | 35,000 | 1200 | 393 |
| 38 Special | 129 | 950 | 255 | 20,000 | 1016 | 291 |
| 357 Mag. | 158 | 1240 | 535 | 45,000 | 1327 | 610 |
| 10 mm Auto | 180 | 1030 | 425 | 37,500 | 1102 | 485 |
| 40 S & W | 155 | 1195 | 445 | 35,000 | 1278 | 507 |
| 44 Rem. Mag. | 240 | 1180 | 740 | 36,000 | 1263 | 844 |
| 45 Auto | 230 | 850 | 370 | 21,000 | 909 | 422 |
| 45 Colt | 255 | 900 | 405 | 14,000 | 965 | 462 |
| 458 Win. Mag. | 500 | 2090 | 4850 | 53,000 | 2236 | 5529 |

Schedule F makes the same comparison as Schedule C except for pistols instead of rifles.

SCHEDULE F

THE CYLINDRICAL AND TAPERED WALL CARTRIDGES AND INTERNAL BARREL CHARACTERISTICS ARE BASED ON ANSI/SAMMI SPECIFICATIONS.

| | A Twist one turn in inches | B Number of grooves | C Bullet circum-ference | D Width of grooves | E Width of groove | F Depth of groove | G Width of lands | H Width of land | I Lands % of circumference |
|---|---|---|---|---|---|---|---|---|---|
| 9 mm Luger | 10 | 6 | 1.115 | .600 | .100 | .0045 | .515 | .085 | .46 |
| 38 Special | 18.75 | 6 | 1.124 | .630 | .105 | .005 | .494 | .082 | .39 |
| 357 Magnum | 18.75 | 6 | 1.124 | .630 | .105 | .0045 | .494 | .082 | .39 |
| 10 mm Auto | 16 | 6 | 1.258 | .720 | .120 | .0052 | .538 | .089 | .43 |
| 40 S & W | 16 | 6 | 1.258 | .720 | .120 | .0052 | .538 | .089 | .43 |
| 44 Rem Mag | 20 | 6 | 1.357 | .642 | .107 | .006 | .715 | .119 | .526 |
| 45 Auto | 16 | 6 | 1.420 | .882 | .147 | .004 | .882 | .147 | .500 |
| 45 Colt | 16 | 6 | 1.432 | .936 | .156 | .004 | .492 | .082 | .343 |
| 458 Win Mag | 14 | 6 | 1.439 | .900 | .150 | .004 | .539 | .090 | .374 |

Figure 2:
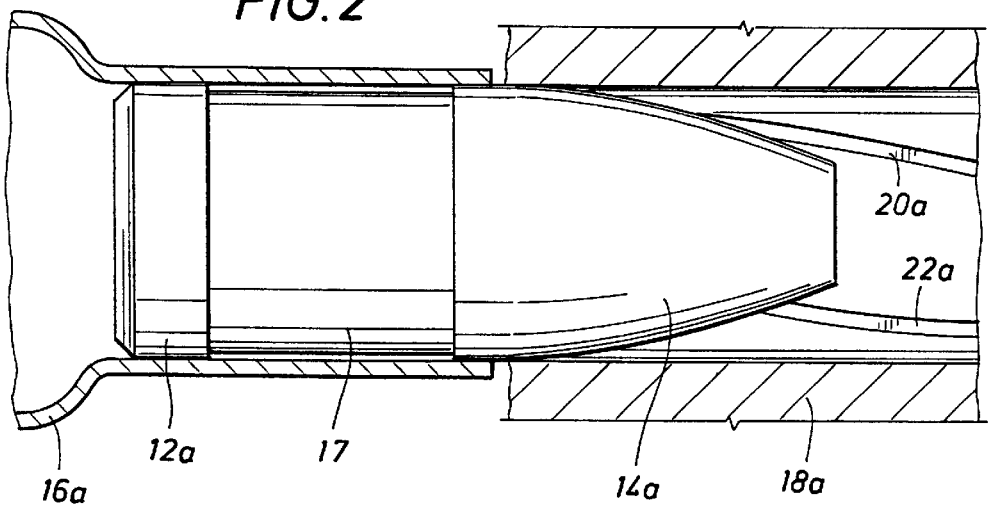
FIG. 2 is a view partly in section and partly in elevation of a bottleneck cartridge assembled with a bullet shaped in accordance with this invention.
Figure 3:
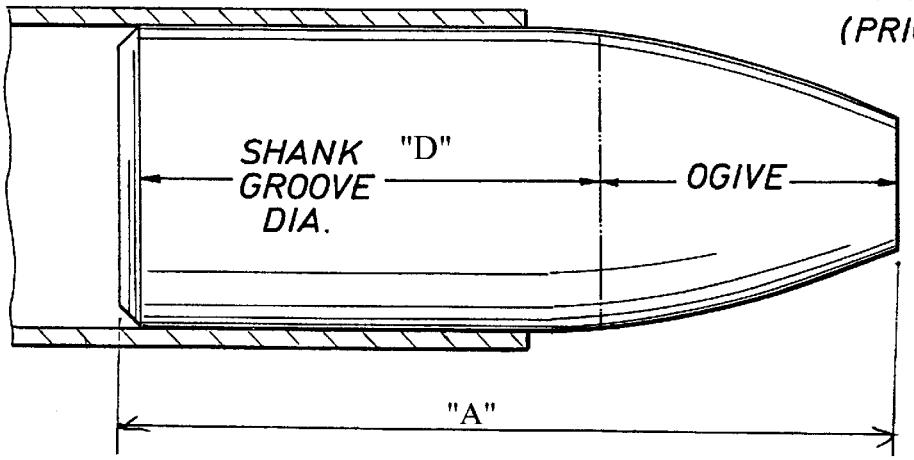
FIG. 3 (PRIOR ART)
FIG. 3 is a view partly in section and partly in elevation of a cylindrical cartridge assembled with a prior art bullet.

The bullet of this invention is shown in FIG. 2. It is the same as the bullet of FIG. 1 except for a friction reducing band (FRB) 17 in cylindrical portion 12*a* of the bullet. Further, FIG. 2 shows an exemplary hollow nose 14*a* and a soft core 19 formed therein. The soft core can be thermally bonded to the nose. FIGS. 3 and 4 are the same as FIGS. 1 and 2 except portions G1, G2, B, and C are identified. These areas of the bullet appear below in the comparison tables.

Figure 5:
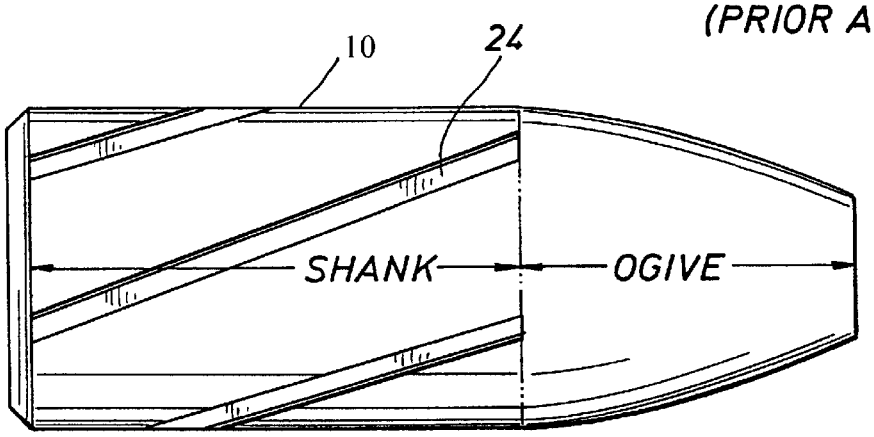
FIG. 5 (PRIOR ART)
FIG. 5 is a side view of a fired prior art bullet showing the grooves formed in the bullet by the rifling in the gun barrel.

FIG. 5 is a side view of a fired prior art bullet. The cylindrical portion 10 of the bullet shows grooves 28 formed by the lands 20 in the barrel 18, shown in FIG. 1.

Figure 6:
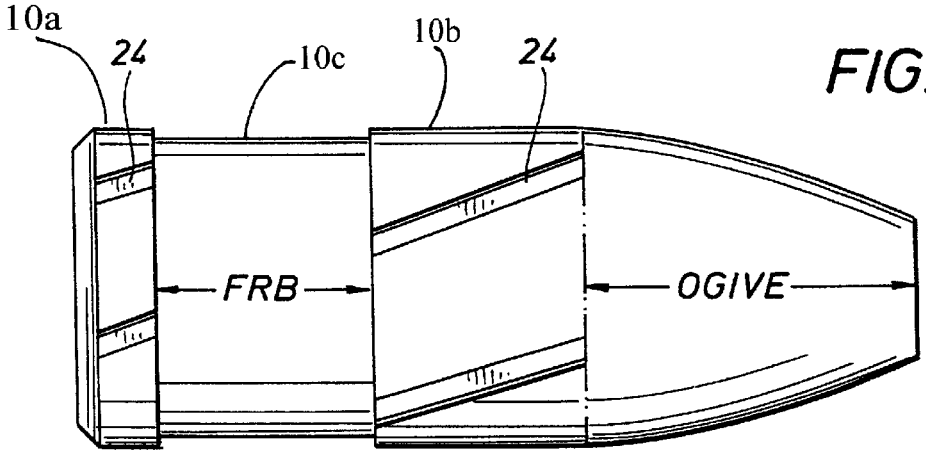
FIG. 6 is a side view of a fired bullet of this invention showing the grooves formed in the bullet by the rifling of the gun barrel.

FIG. 6 is a side view of a fired bullet of the present invention. Grooves 28 are developed in the sections 10*a*, 10*b* by the lands 20*a* in the barrel 18*a*, shown in FIG. 2. The FRB section 10*c* is diametrically sized to avoid engagement with the lands.

FIGS. 7*a–d* show an increasing weight on the rear end 29 of the bullet. The weight can be added at a reduced diameter, such as a tapered diameter, to avoid additional engagement with the lands of the barrel shown in FIG. 2.

Figure 7A:
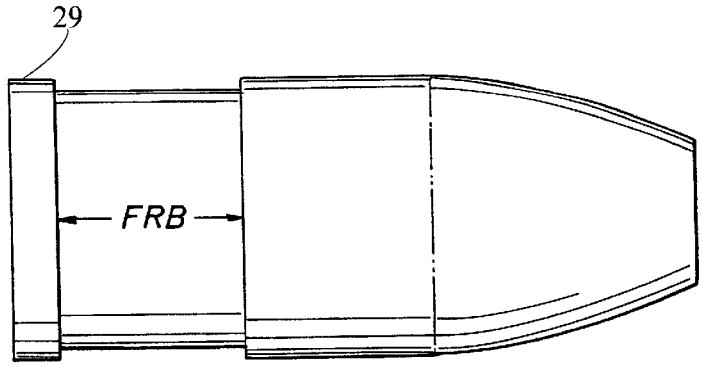
Figure 7B:
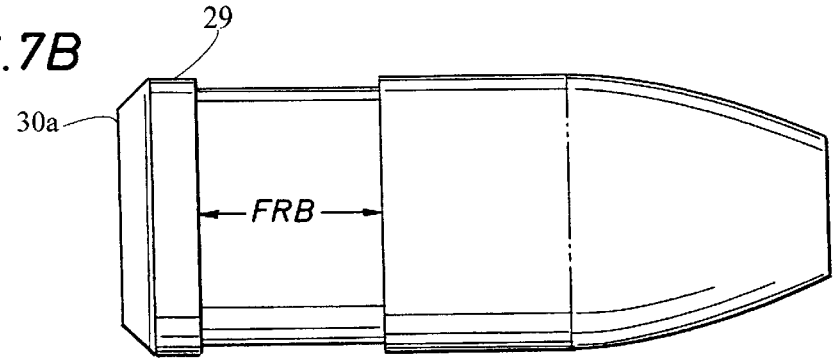
Figure 7C:
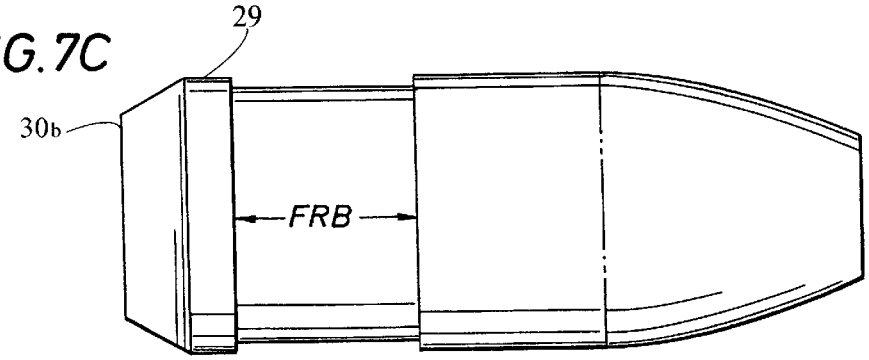
Figure 7D:
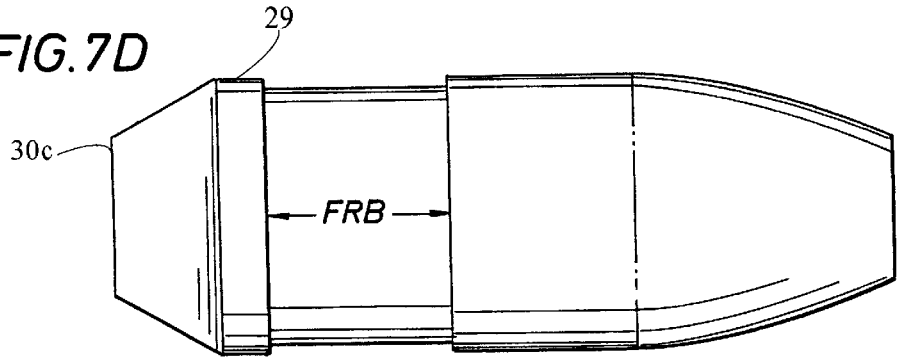
Figure 1:
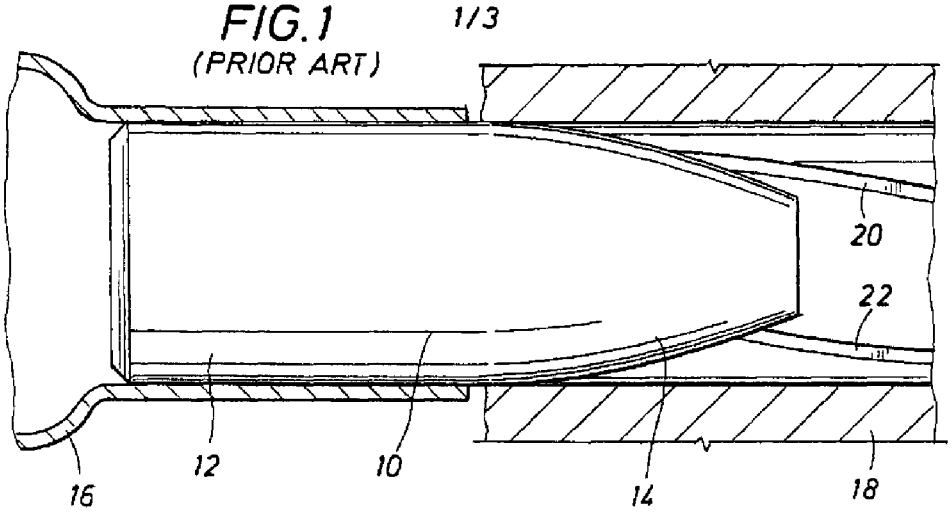
FIG. 1 (PRIOR ART)
Figure 2:
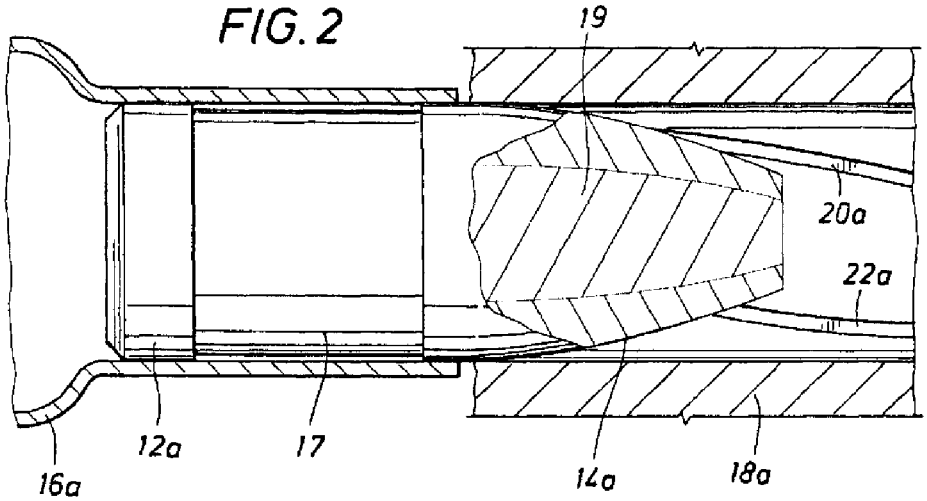
Figure 3:
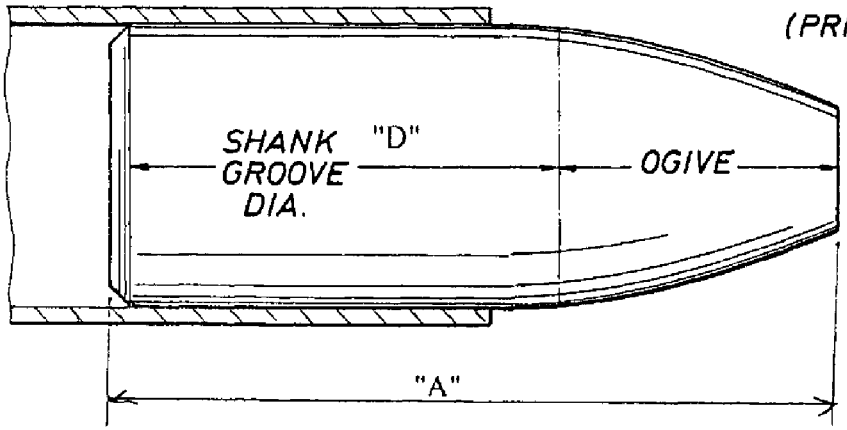
FIG. 3 (PRIOR ART)

FIG. 7*a* is a schematic of a bullet without added material and can be, for example, a low bullet weight of the particular caliber, FIGS. 7*b*–7*d* show increasing amounts of the added material. Merely for exemplary purposes and without limitation, a bullet could have a weight of 150 grains with a profile shown in FIG. 7*a*. FIG. 7*b* shows an added material 30*a* at a reduced diameter that can add, for example, 15 grains of material so that the bullet weighs 165 grains. FIG. 7*c* shows an added material 30*b* that is greater than 30*a*, such as 30 grains, so that the bullet weighs 180 grains. FIG. 7*d* shows added material 30*c* that is greater than 30*b*, such as 50 grains so that the bullet weighs 200 grains. Thus, weight can be added to a bullet without affecting the amount of bullet contact with lands of the barrel.

What is claimed is:

1. A controlled expansion bullet for mounting in the hollow end of a cartridge, said bullet having a solid cylindrical base and a hollow ogive shaped nose, a soft core in the hollow nose and thermally bonded to the hollow nose, said cylindrical base portion comprising:

a base shank portion comprising a single forward shank region G2 and a single terminal shank region G1 both dimensioned cross-sectionally to engage and be compressed by lands within a gun barrel and wherein G2 exceeds G1 in longitudinal length and is dimensioned to accommodate attachment to a shell case, and a single circumferential friction reduction band (FRB) located between G1 and G2 and having a diameter less than the lands and of sufficient longitudinal length to reduce the total length of the base shank portion (G1+G2+FRB) which contacts the lands by about 41–65%;

a tapered weighted region extending from the terminal shank region to provide additional weight without contacting said lands; and a tapered nose portion extending from the forward shank region having a blunt forward end leading to the soft core for controlled expansion of the bullet upon firing, wherein the improvements together result in an increased muzzle velocity of approximately 7% and in increased kinetic energy of about 14% for a given pressure compared to a bullet without the FRB at the given pressure.

2. The bullet of claim 1 in which the longitudinal length of G1+G2 is between about 14–31% of the overall bullet length.

3. The bullet of claim 2 in which the longitudinal length of G1+G2 is of sufficient length to reduce the total length of the base shank portion (G1+G2+FRB) which contacts the lands by about 41–61%.

4. The bullet of claim 2 in which the bullet yields a muzzle velocity in the range of about 969–3466 feet per second upon firing.

5. The bullet of claim 2 in which the bullet yields a muzzle velocity in the range of about 2236–3466 feet per second upon firing.

6. The bullet of claim 2 in which the bullet attains a maximum kinetic energy in the range of about 291–5872 foot pounds upon firing.

7. The bullet of claim 2 in which the bullet attains a maximum kinetic energy in the range of about 1459–5872 foot pounds upon firing.

8. The bullet of claim 1 in which the longitudinal length of G1+G2 is within about 17–25% of the overall bullet length.

9. The bullet of claim 8 in which the longitudinal length of G1+G2 is of sufficient length to reduce the total length of the base shank portion (G1+G2+FRB) which contacts the lands by about 50–65%.

10. The bullet of claim 8 in which the bullet yields a muzzle velocity in the range of about 909–1327 feet per second upon firing.

11. The bullet of claim 8 in which the bullet attains a maximum kinetic energy in the range of about 291–844 foot pounds upon firing.

* * * * *

UNITED STATES PATENT AND TRADEMARK OFFICE

CERTIFICATE OF CORRECTION

PATENT NO. : 6,439,125 B1
APPLICATION NO. : 09/013962
DATED : August 27, 2002
INVENTOR(S) : Herman L. Carter It is certified that error appears in the above-identified patent and that said Letters Patent is hereby corrected as shown below:

The title page should be deleted and substitute therefor the attached title page.

Replace sheet 1 of the drawings with the attached sheet 1.

Col. 9, line 32 and line 35, please replace “28” with “24” for the grooves.

Signed and Sealed this

Ninth Day of June, 2009

JOHN DOLL
*Acting Director of the United States Patent and Trademark Office*

(12) United States Patent
Carter

(10) Patent No.: US 6,439,125 B1
(45) **Date of Patent: *Aug. 27, 2002**

(54) BULLET

(75) Inventor: Herman L. Carter, Houston, TX (US)

(73) Assignee: Friedkin Companies, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/013,962

(22) Filed: Jan. 27, 1998

(51) Int. Cl.[7] ..... F42B 12/34; F42B 14/02

(52) U.S. Cl. ..... 102/507; 102/514; 102/524

(58) Field of Search ..... 102/430, 439, 102/501, 511, 514–518, 524, 526, 507–510

(56) References Cited

U.S. PATENT DOCUMENTS

| | | | | | |
|---|---|---|---|---|---|
| 2,120,913 | A | * | 6/1938 | Studler | 102/516 |
| 2,234,165 | A | * | 3/1941 | Hatcher et al. | 102/526 |
| 2,333,091 | A | | 11/1943 | Crasnoff | 102/91 |
| 2,568,078 | A | * | 9/1951 | McGahey, Jr. | 102/430 |
| 2,792,618 | A | | 5/1957 | Walker | 29/1.23 |
| 2,838,000 | A | | 6/1958 | Schreiber | 102/92.5 |
| 3,003,420 | A | | 10/1961 | Nosler | 102/91 |
| 3,069,748 | A | | 12/1962 | Nosler | 29/1.23 |
| 3,143,966 | A | | 8/1964 | Burns, Jr. et al. | 102/91 |
| 3,918,364 | A | * | 11/1975 | Duer | 102/501 |
| 4,336,756 | A | | 6/1982 | Schreiber | 102/516 |
| 4,879,953 | A | * | 11/1989 | Carter | 102/507 |
| 5,463,960 | A | * | 11/1995 | Lowry | 102/524 |
| 5,686,693 | A | * | 11/1997 | Jakobsson | 102/524 |

FOREIGN PATENT DOCUMENTS

| | | | | |
|---|---|---|---|---|
| DE | 40875 | * | 10/1887 | 102/501 |
| DE | 48041 | | 1/1989 | |
| FR | 776005 | | 1/1935 | |
| GB | 1972 | * | 4/1883 | 102/430 |

* cited by examiner

*Primary Examiner*—Harold J. Tudor
(74) *Attorney, Agent, or Firm*—Locke Liddell & Sapp LLP

(57) ABSTRACT

The invention relates to a bullet having a tapered nose and a cylindrical base. The base is provided with an annular groove having a diameter less than the bore diameter of the barrel of the gun from which it is fired to reduce the force required to move the bullet through the barrel to increase the muzzle velocity and kinetic energy of the bullet.

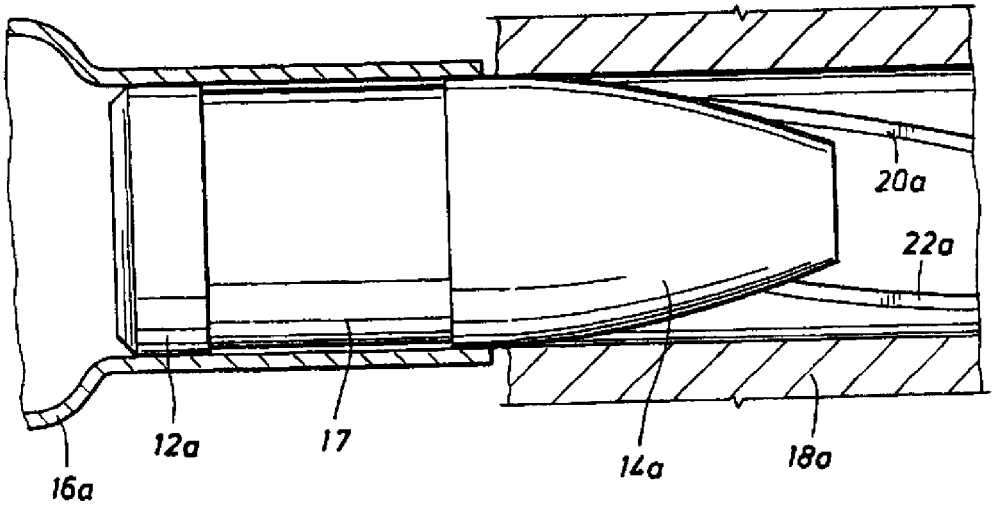

11 Claims, 3 Drawing Sheets